US008256463B2

(12) United States Patent
Farag et al.

(10) Patent No.: US 8,256,463 B2
(45) Date of Patent: Sep. 4, 2012

(54) FAUCET WITH ADJUSTABLE HEIGHT SPOUT

(75) Inventors: Hanna O. Farag, Riverside, CA (US); Aaron E. Hanna, Corona, CA (US)

(73) Assignee: Newfrey LLC, Newark, DE (US)

( * ) Notice: Subject to any disclaimer, the term of this patent is extended or adjusted under 35 U.S.C. 154(b) by 414 days.

(21) Appl. No.: 12/657,974

(22) Filed: Jan. 29, 2010

(65) Prior Publication Data

US 2011/0186162 A1 Aug. 4, 2011

(51) Int. Cl.
*F16K 21/00* (2006.01)

(52) U.S. Cl. ..... 137/801

(58) Field of Classification Search ..... 137/801; 4/675–678; 239/281
See application file for complete search history.

(56) References Cited

U.S. PATENT DOCUMENTS

| | | | | |
|---|---|---|---|---|
| 1,360,382 | A * | 11/1920 | Edwards | 285/302 |
| 2,754,137 | A * | 7/1956 | Gine et al. | 285/145.1 |
| 4,457,342 | A * | 7/1984 | Moen | 137/801 |
| 5,135,173 | A | 8/1992 | Cho | |
| 5,871,029 | A * | 2/1999 | Peteri et al. | 137/801 |
| 6,273,138 | B1 | 8/2001 | Yoney | |
| 6,394,133 | B1 | 5/2002 | Knapp | |
| 7,389,796 | B2 | 6/2008 | Vilhelmsen | |
| 2006/0180222 | A1 | 8/2006 | Kang | |
| 2010/0116370 | A1 * | 5/2010 | Lacher | 137/801 |

FOREIGN PATENT DOCUMENTS

| | | |
|---|---|---|
| JP | 3382568 B | 3/2001 |
| WO | WO8706861 | 11/1987 |

* cited by examiner

*Primary Examiner* — Craig Schneider
(74) *Attorney, Agent, or Firm* — Ober, Kaler, Grimes & Shriver; Royal W. Craig

(57) ABSTRACT

A faucet spout having an adjustable height relative to a stationary base or surface to which it may be mounted. A spout tube is slideably engaged within a spout body in which a support member is housed. The support member is received within the spout tube and provides a positive stop at a lowest position. A ratchet assembly within the support member engages the end of the spout tube at any one of a series of ratchet teeth providing a variety of additional stops/heights at which the spout tube may be retained for operation. A release button withdraws the ratchet arm and permits the spout tube to return to the first stop at its lowest point.

20 Claims, 7 Drawing Sheets

Detail A of FIG. 5a

Detail A of FIG. 6a

Detail A of FIG. 7a

Detail A of FIG. 8a

FAUCET WITH ADJUSTABLE HEIGHT SPOUT

BACKGROUND OF THE INVENTION

1. Field of the Invention

The present invention relates generally to faucet spouts and more particularly to a faucet spout having an adjustable height relative to a fixed base.

2. Description of the Background

Large objects such as pots are often too tall to fit under the spout of a kitchen sink faucet such that they must be filled by repeatedly filling a smaller vessel and emptying the smaller vessel into the large pot. Cleaning of large pots and other such large objects is equally difficult if they are similarly too large to fit under the faucet spout while in the sink basin. Pull-out, handheld wand type faucets offer a partial solution to the problem but occupy one hand leaving only one free hand to perform the task to be completed. An adjustable height faucet permitting hands free operation after adjustment would be desirable.

BRIEF DESCRIPTION OF THE DRAWINGS

The objects, features, and advantages of the present invention will become apparent from the following detailed description of the preferred embodiments and certain modifications thereof when taken together with the accompanying drawings in which like numbers represent like items throughout and in which.

DETAILED DESCRIPTION OF THE PREFERRED EMBODIMENT

Figure 3:
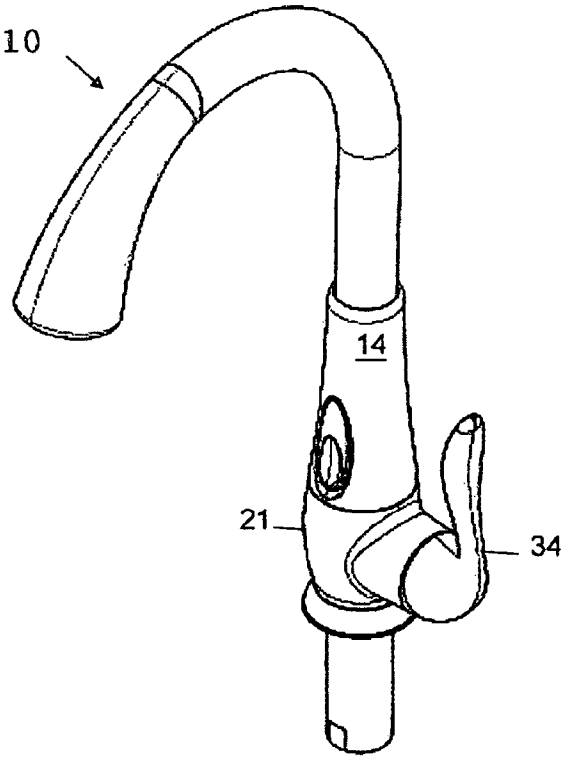
FIG. 3 is a perspective view of a faucet according to the present invention at its highest spout set point.

For the purposes of promoting an understanding of the principles of the invention, reference will now be made to the exemplary embodiment illustrated in the drawings and described below. The embodiment disclosed is not intended to be exhaustive or limit the invention to the precise form disclosed in the following detailed description. Rather, the embodiment is chosen and described so that others skilled in the art may utilize its teachings. It will be understood that no limitation of the scope of the invention is thereby intended. The invention includes any alterations and modifications in the illustrated device, the methods of operation, and further applications of the principles of the invention which would normally occur to one skilled in the art to which the invention relates.

Figure 2:
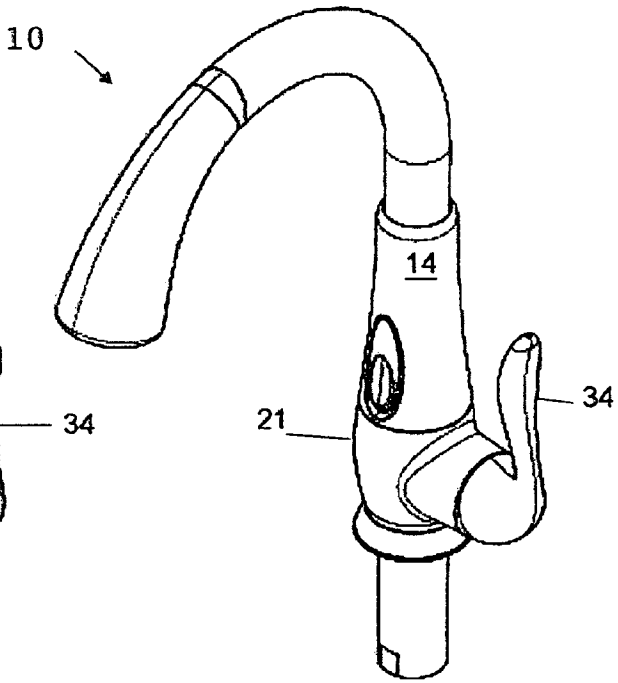
FIG. 2 is a perspective view of a faucet according to the present invention at an intermediate spout height set point.
Figure 1:
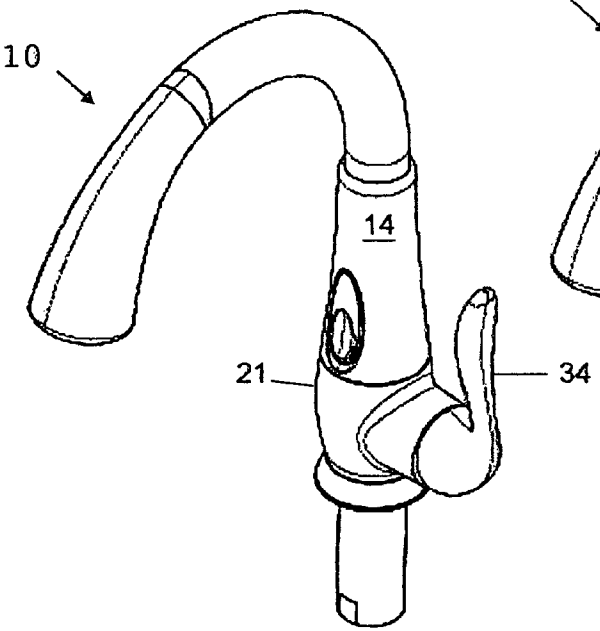
FIG. 1 is a perspective view of a faucet according to the present invention at its lowest spout height set point.

The invention is a faucet having an adjustable outlet height relative to a stationary base or surface to which it may be mounted. For purposes of this application a preferred embodiment of the present invention is illustrated in FIGS. 1-3, which show a unitary faucet assembly generally including a spout 10 mounted atop a mixing valve body 21, which is in turn adapted to be mounted on a stationary base or surface such as a sink. A flow control handle 34 is journaled into the mixing valve body for operation thereof. The spout 10 includes a spray head 36, spout tube 12 and spout body 14, and internal components (obscured) to be described. The spout 10 is telescopically extendable in height as progressively shown in FIGS. 1-3 and as described in detail below. The invention may alternately be utilized with a mixing valve body 21 and flow control handle 34 mounted separately from the spout 10.

Figure 4:
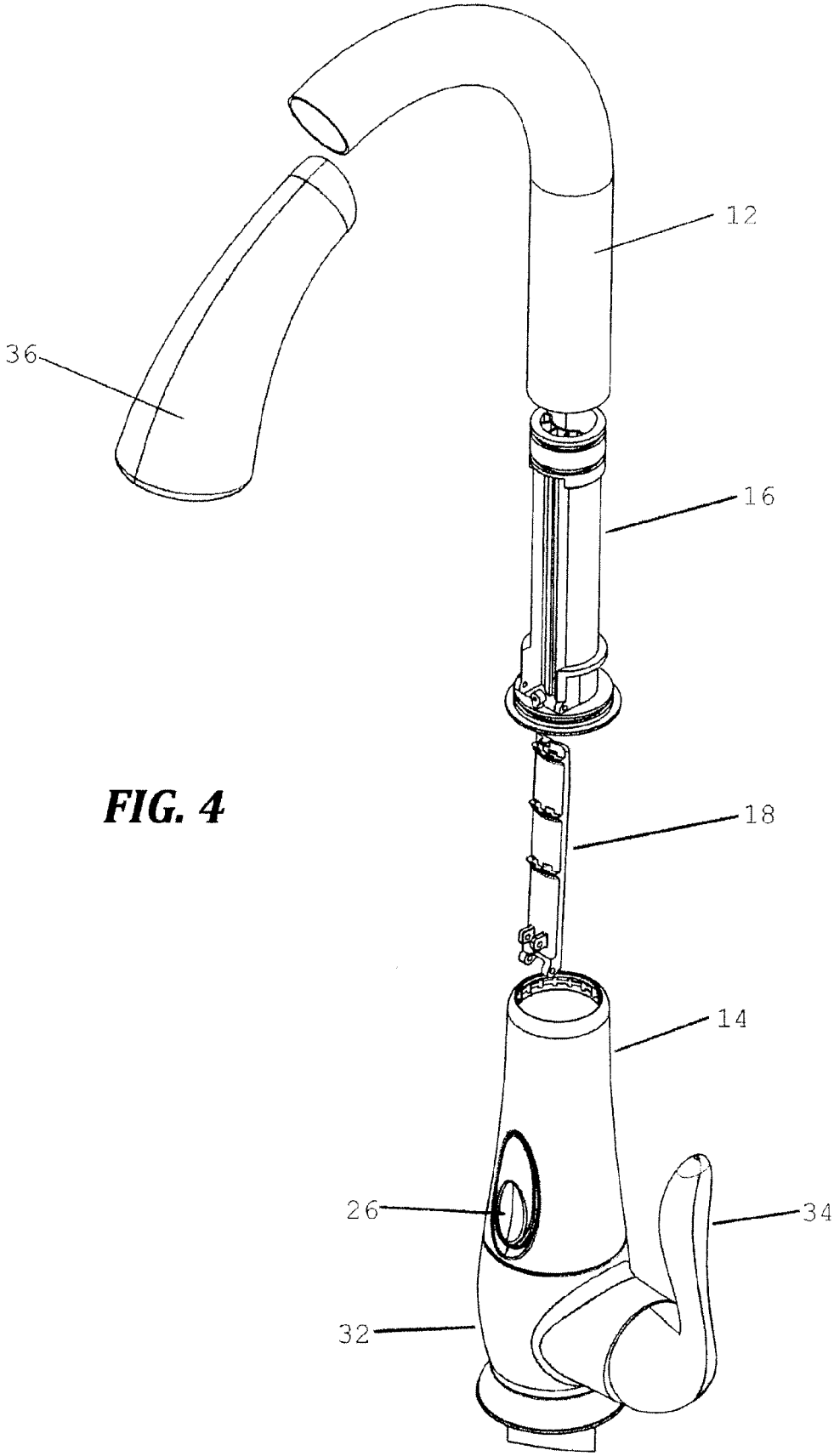
FIG. 4 is an exploded perspective view of a faucet according to the present invention.

With reference to FIG. 4, an exploded view of the adjustable height faucet as in FIGS. 1-3. Spout 10 includes a spray head 36 mounted to a spout tube 12. Spray head 36 may be fixed in spout tube 12 or may be a removable wand type spray head connected by flexible hose in a conventional manner. In either spray head 36 may be connected to spout tube 12 at a circular junction to permit rotation of the spray head 36 within spout tube 12. Spout tube 12 is slidably inserted into spout body 14 at a circular junction to permit both rotation and extension of the combined spout tube 12 and spray head 36 within spout body 14. This facilitates full articulation within the spray head 36 to facilitate manipulation of water flow from the spray head 36 over a sink basin. As illustrated, spout tube 12 is an arcuate tubular member.

The spout tube 12 is received within spout body 14, the latter being generally cylindrical (here a fluted cylinder) and having a preferably circular top opening to cooperatively receive the cylindrical exterior surface of the spout tube 12, which is telescopically inserted therein. An aperture is provided through the sidewall of the spout body 14 for exposing a release button 26 within easy access of a user in order to extend or retract the spout tube 12, as described below. The spout body 14 is mounted on a valve body 32 having a flow control handle 34 journeled therein. The valve body 21 may be mounted to a countertop surface or sink apron (not pictured) as is generally known in the art.

Figure 5A:
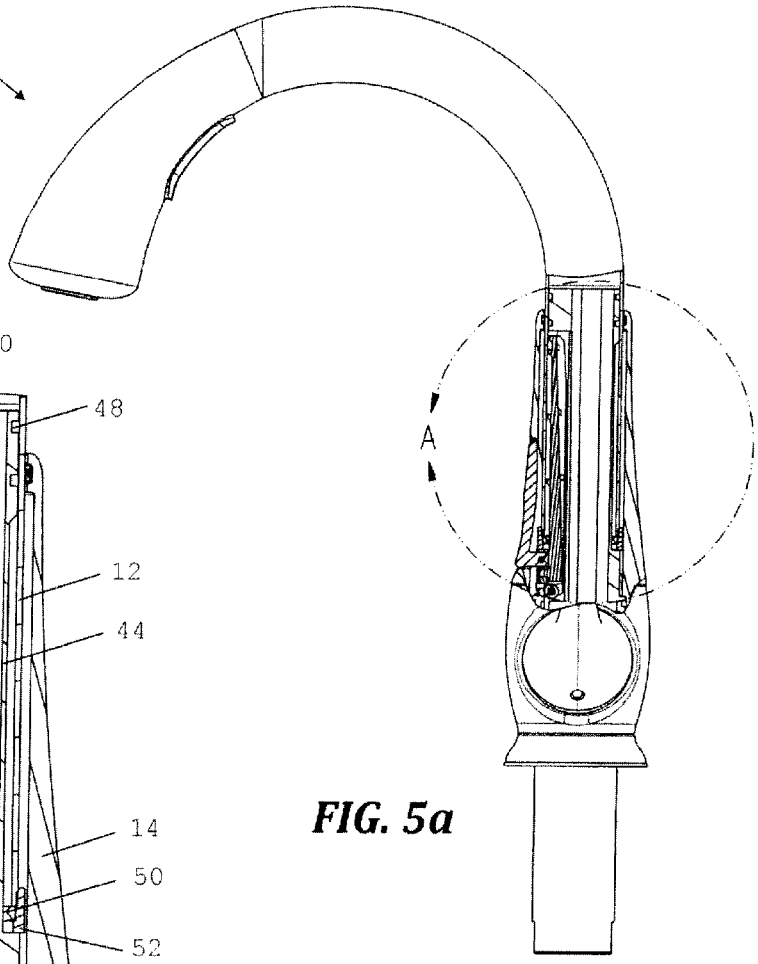
FIG. 5*a* is a partially cut-away side view of a faucet according to the present invention in which the spout is in its lowest set point as in FIG. 1.
Figure 5B:
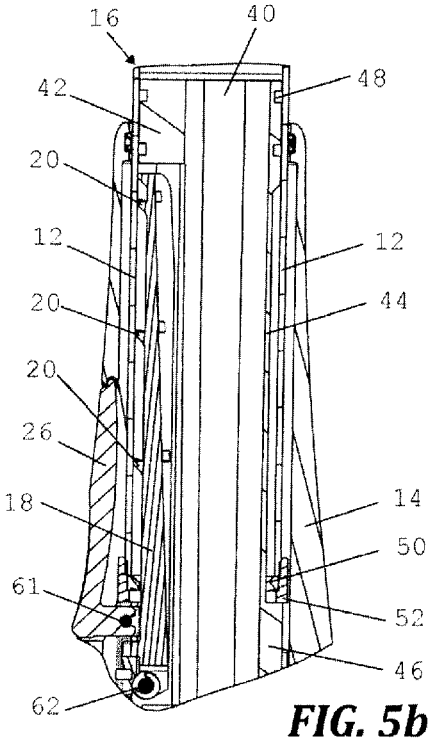
FIG. 5*b* is a detailed section view of the cut-away portion A of the sides view FIG. 5*a*.
Figure 9:
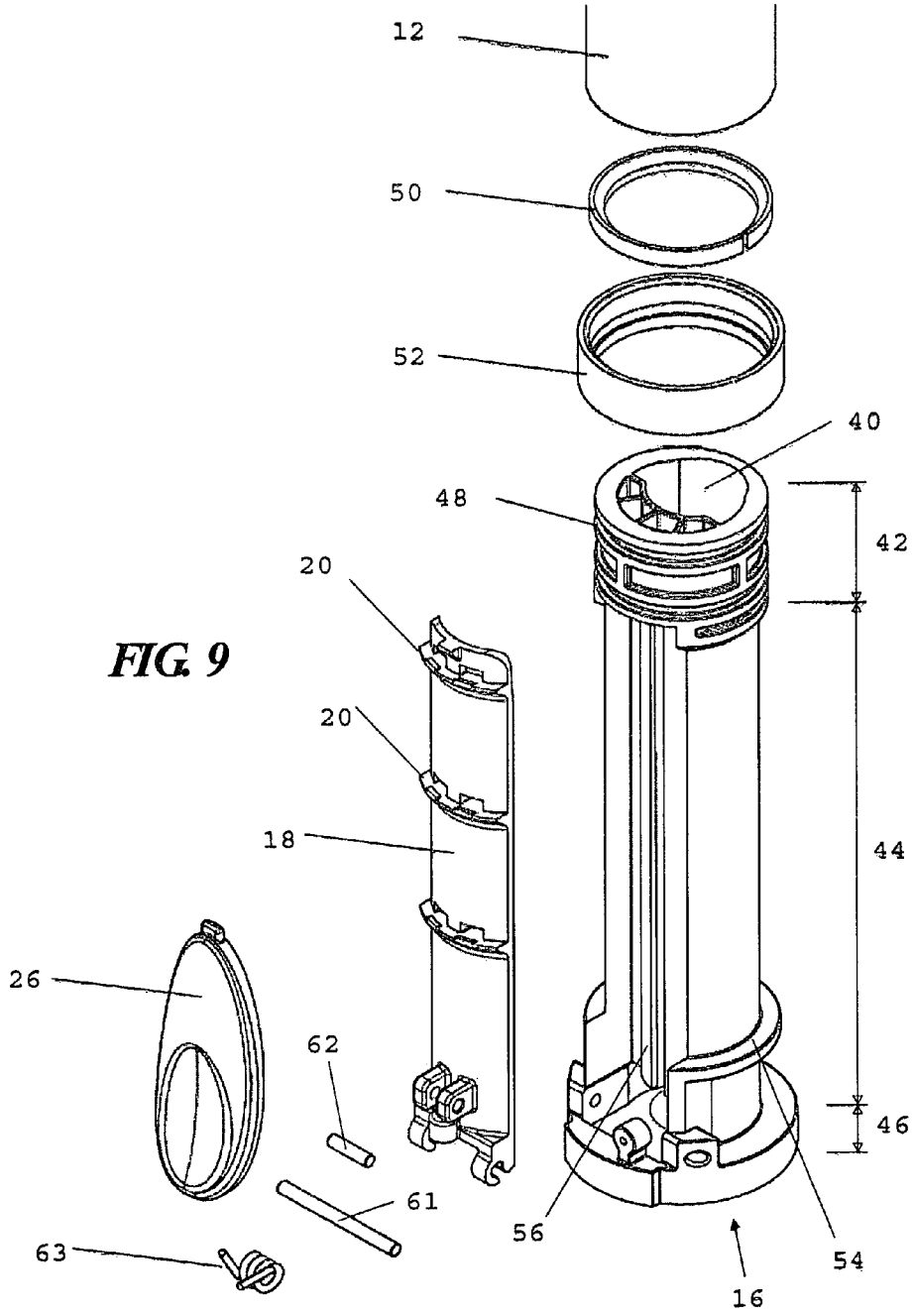
FIG. 9 is detail exploded perspective view of the ratchet assembly according to the present invention.

With additional reference to FIGS. 5*a*, 5*b* and 9, a support member 16 is fixedly mounted within the spout body 14. The support member 16 is a generally cylindrical cartridge having a longitudinal void 40 extending through its length. The support member 16 is provided with a relieved exterior surface to permit insertion and operation of additional components (described below). Support member 16 is characterized by an upper portion 42, a middle portion 44 and base portion 46. The upper portion 42 of the support member 16 has a circular cross section of a diameter to be snugly received inside the spout tube 12. The upper portion 42 may be ribbed with annular grooves 48, and one or more resilient O-rings may be seated in the annular grooves 48 around the upper portion to provide a frictional dampened engagement with the inner surface of the spout tube 12 and hence smooth rotation of the spout tube 12 about the support member 16.

The base portion 46 of the support member 16 forms an annular flange for mounting within the spout body 14. The middle portion 44 is preferably cylindrical and extends from the base portion 46 to the upper portion 42 with a recessed diameter less than that of the upper portion so as not to impede passage of the spout tube 12. The spout tube 12 is, however, provided at its lower end with an annular ring 50 (FIG. 5*b*) of reduced diameter that engages and rides on the outer surface of the middle portion 44 of the support member 16. Annular ring 50 may beheld in place by a cap 52 placed over the end of the spout tube 12. The annular ring 50 is preferably a split ring to facilitate installation after the spout tube 12 has been inserted over the upper portion 42 of the support member 16. A cooperative partial annular ring 54 of increased radius on the external surface of the middle portion 44 of the support member 16 provides a positive stop for the spout tube 12 when retracted into the spout body 14 to its lowest position, as depicted in FIG. 5*b*.

As best seen in FIG. 9, a longitudinal slot 56 is provided extending along the outer surface of the middle portion 44 from the base portion 46 to the upper portion 42 interrupting the partial annular ring 54. The longitudinal slot 56 is aligned with the sidewall release button aperture in the spout body 14 and seats a ratchet arm 18 that is pivotably affixed to the support member 16 at or near the base portion 46. The ratchet arm 18 extends substantially the length of the longitudinal slot 56 and preferably pivots about a pin 61, but may be connected by any other suitable means that permits rotation including snap-detent pin hinges or a living (flexure) hinge. The axis of rotation of the ratchet arm 18 is perpendicular to the longitudinal axis of the support member 16 such that the distal end of the ratchet arm 18 translates radially with respect to the support member 16 when the ratchet arm 18 is pivoted about pin 61.

Figure 6A:
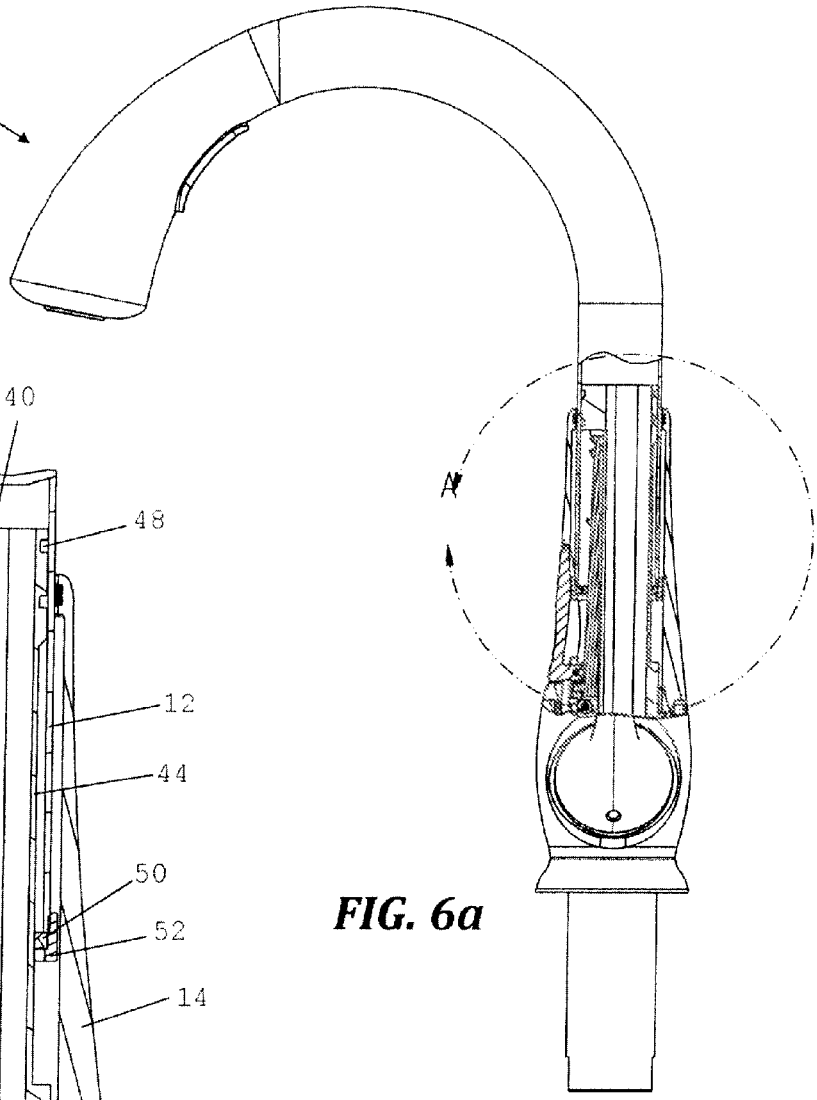
FIG. 6*a* is a partially cut-away side view of a faucet according to the present invention in which the spout height is being lifted to an intermediate set point as in FIG. 2.
Figure 6B:
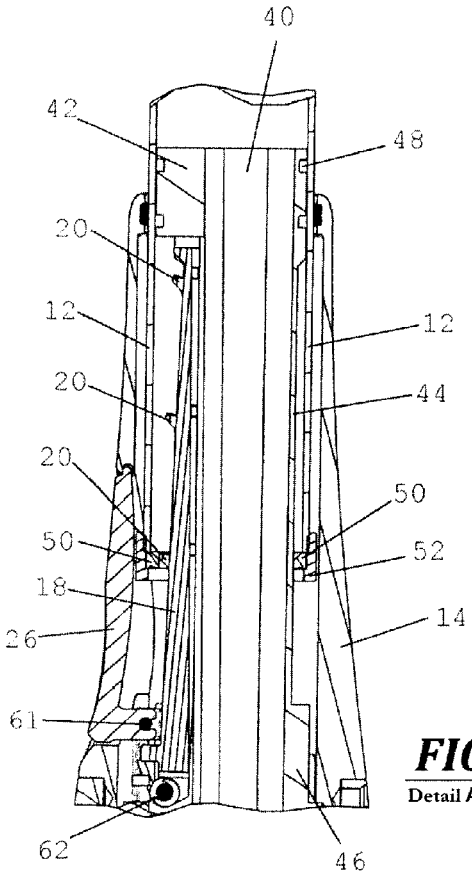
FIG. 6*b* is a detailed section view of the cut-away portion A of the sides view FIG. 6*a*.

The outside surface of the ratchet arm 18 is provided with a series of asymmetrical teeth 20 spaced lengthwise, and each characterized by a moderately sloped lower surface and a severely sloped to flat upper surface. Thus, when pivoted into a stowed position (as seen in FIG. 6*b*) the entirety of the ratchet arm 18 including the teeth 20 are contained with the longitudinal slot 56 to permit passage of the spout tube annular ring 50 as the spout tube 12 is slid (lowered) downward into the spout body 14. When deployed, the distal end of the ratchet arm 18 extends outwardly to engage the inner surface of the spout tube 12. Specifically, the teeth 20 project into the path of the spout tube annular ring 50 and act as interim stops at varying elevations. The ratchet arm 18 is return-biased toward the deployed position by spring 63. It should be observed that a simplified embodiment of the present invention having only two spout positions could omit the teeth 20 and utilize the distal end of the ratchet arm 18 as the single stop. In such an embodiment the annular ring 50 can be omitted as well.

The release button 26 is affixed to the ratchet arm 18 and remains accessible through the sidewall aperture of the spout body 14. The release button 26 is preferably pivotably affixed to the ratchet arm 18 by a pin 62 engaged to a yoke 19 situated below the partial annular ring 54 of the support body 16 so as not to interfere with spout tube 12 in its lowest position (FIG. 5*b*). Depressing the release button 26 overcomes the force of the biasing spring 63 and rotates the ratchet arm 18 into the stowed position. This configuration leverages the ratchet arm 18, such that actual travel of the release button 26 may be as small as 1 mm although the travel of the distal end of the ratchet arm 18 will be greater. Alternately, the release button 26 may be rigidly affixed to the ratchet arm 18 in which case overall travel of the button 26 is increased, but in this case it becomes more difficult to seal the spout body sidewall aperture.

Figure 7A:
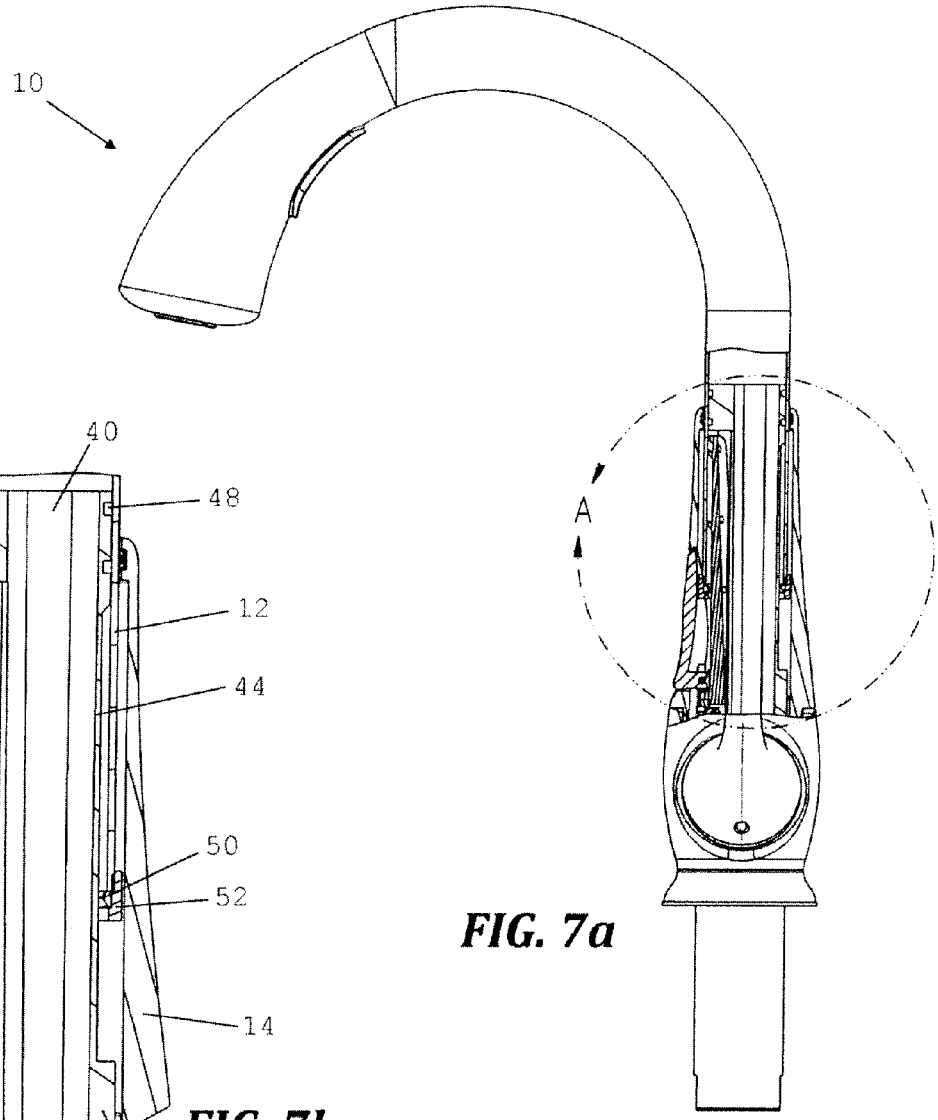
FIG. 7*a* is a partially cut-away side view of a faucet according to the present invention in which the spout height is at its highest set point as in FIG. 3.
Figure 7B:
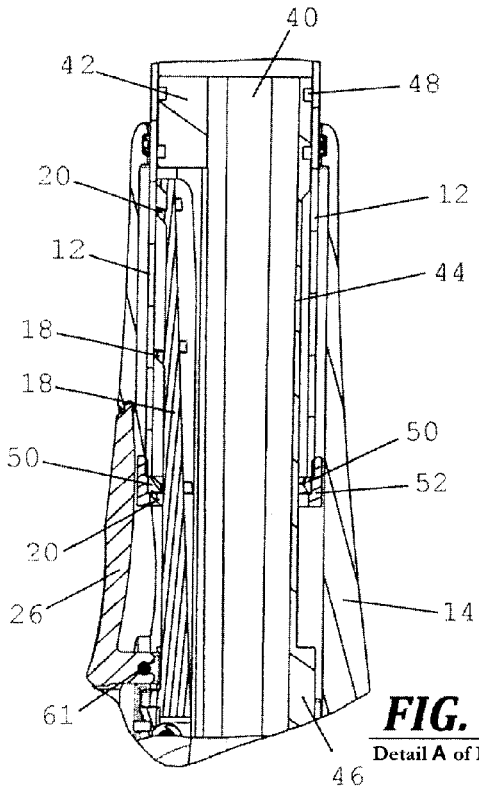
FIG. 7*b* is a detailed section view of the cut-away portion A of the sides view FIG. 7*a*.

Operationally, the spout 10 is at its lowest position as depicted in FIG. 1 and FIGS. 5*a* and 5*b*. When a user wishes to raise the spout 10 he lifts the spout tube 12 which slides up the support member 16. When the spout tube annular ring 50 engages the moderately sloped underside of the first tooth 20 it momentarily overcomes the force of the spring bias causing the ratchet arm 18 to rotate into the stowed position and allow the spout tube annular ring 50 to pass (FIGS. 6*a* and 6*b*). Once past, the ratchet arm 18 returns to the deployed position. If the user is satisfied with the height of the spout in this position the spout tube 12 is released and the spout tube annular ring 50 comes to rest on the flat upper surface of the tooth 20 which serves as a ratchet (FIGS. 2, 7*a* and 7*b*), thereby preventing the spout tube 12 from falling back to its original state.

Figures 8A, 8B:
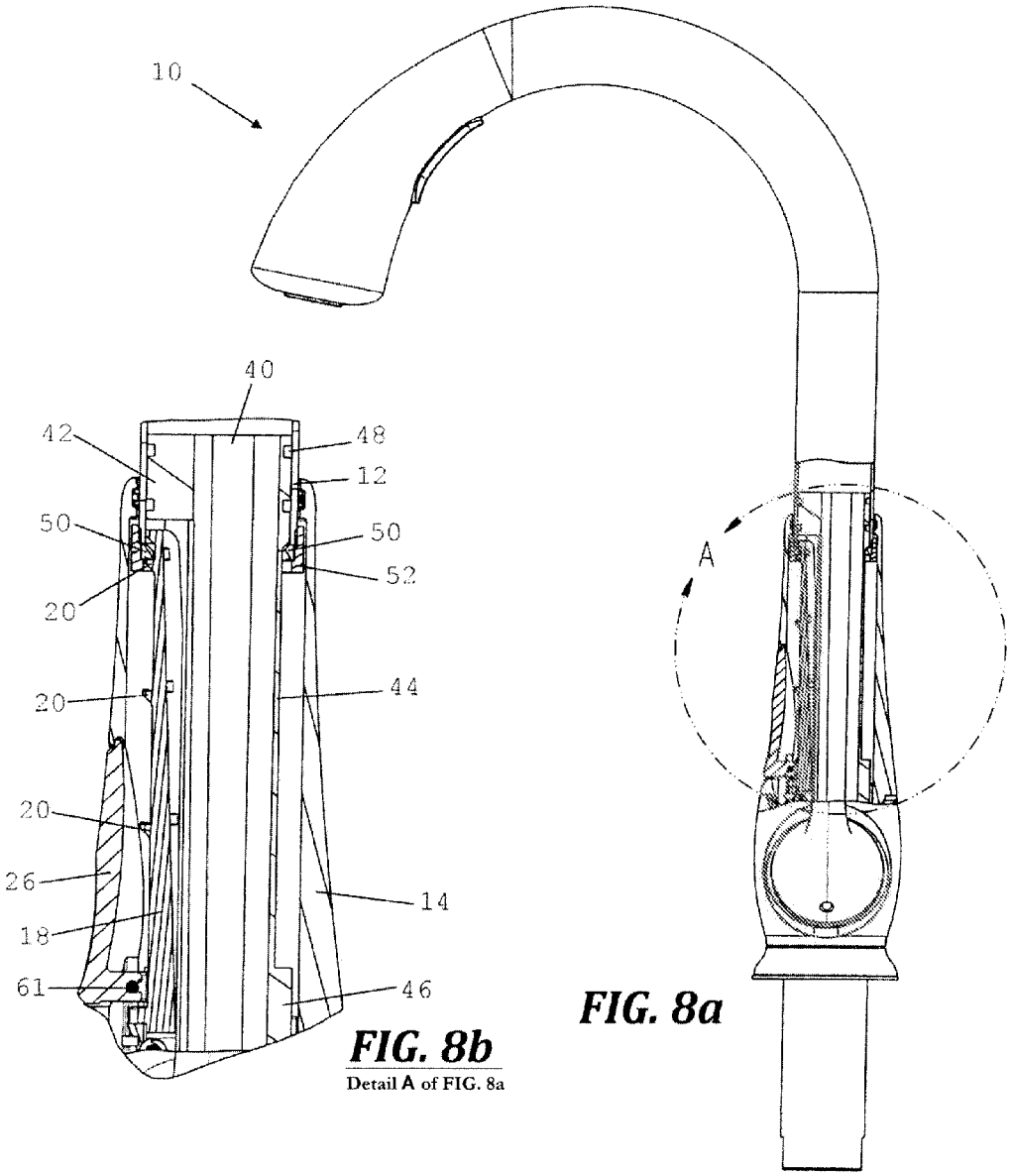
FIG. 8*a* is a partially cut-away side view of a faucet according to the present invention in which the spout height is at its highest set point as in FIG. 3.
FIG. 8*b* is a detailed section view of the cut-away portion A of the sides view FIG. 8*a*.

The user may continue to the lift the spout tube 12 to a higher position and the ratcheting operation repeats in the same manner as the spout tube annular ring 50 engages the second or third teeth (FIGS. 3, 8*a* and 8B) of the ratchet arm 18. The spout tube annular ring 50 prevents the spout tube 12 from being lifted past the third tooth 20 by engaging the underside of the upper portion 42 of the support member 16. The upper surface of the spout tube annular ring 50 may be cooperatively sloped with respect to the moderate slope of the underside of the teeth 20 or the upper portion of the support member 16 so as to increase the contact area in order to provide more stable operation and better wear characteristics.

When the user wishes to lower the spout tube 12 the release button 26 is pressed causing the ratchet arm 18 to rotate into the stowed position. As described, with the ratchet arm 18 in this position the teeth 20 are cleared from the path of the spout tube annular ring 50 and the spout tube 12 can be lowered until the release button 26 is released, at which point it will be stopped by the next encountered tooth 20 or the support member annular ring 54 in the lowest position. Rotation of the spout tube 18 is independent of and has no effect on the operation of the height adjustment system.

In the depicted embodiment the adjustable height spout body 14 is mounted directly to a valve body 32 containing an internal flow control valve of conventional construction, operatively connected to the control handle 34. The spray head 36 is preferably fluidly connected to the flow control valve by flexible tubing passing through the longitudinal void 40 of the support member 16. In an alternate embodiment the support member 16 may be constructed so as to receive the circular spout tube within a circular central void such that the entire inside diameter of the spout tube is available for the flexible tubing. In such an embodiment an enlarged spout body may be required. Additionally, the ratchet arm 18 may be reoriented 180° so that the teeth engage an annular ring on the outside surface of the spout tube 12, and operation of the release would be reversed. All other elements would operate under the same principals.

Having now fully set forth the preferred embodiment and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth in the appended claims and may be used with a variety of materials and components. This application is therefore intended to cover any variations, uses, or adaptations of the invention using its general principles. Further, this application is intended to cover such departures from the present disclosure as come within known or customary practice in the art to which this invention pertains.

We claim:

1. A faucet spout having an adjustable height comprising:

a spout tube having an input end, an inside surface and an outside surface;

a spout body having an aperture in a top surface for slideably receiving said input end of said spout tube to at least a first position wherein the height of said spout is at a first elevation and a second position wherein the height of said spout is at a second elevation that is higher than said first elevation;

a support member contained within said spout body, said support member being slideably received within the spout tube and engaging said inner surface when said spout tube is received in said spout body; said support member further comprising:

a first stop, said first stop engaging said spout tube when said spout tube is received in said spout body to said first position;

a detent arm pivotably mounted to said support member, said detent arm being pivotable to a stowed position unobstructing of said spout tube when said spout tube is received in said spout body to said first position, and to a deployed position in which a second stop on said detent arm engages said spout tube when said spout tube is received in said spout body to said second position; and a release engaging said detent arm to cause said detent arm to pivot between said deployed position and said stowed position.

2. The faucet spout of claim 1 wherein said input end of said spout tube further comprises an annular ring protruding radially inward from said inside surface, and said detent arm further comprises a plurality of teeth regularly spaced along an external surface, at least a first tooth engaging said annular ring and comprising said second stop when said spout tube is received in said spout body to said second position and a second tooth engaging said annular ring and comprising a third stop when said spout tube is received in said spout body to a third position.

3. The faucet spout of claim 2 wherein said plurality of teeth are asymmetrically formed having a sloped lower surface and a substantially flat upper surface such that said annular ring may slide past said teeth in only one direction.

4. The faucet spout of claim 1 further comprising a spring mounted to said support member and engaging said detent arm to bias said detent into said deployed position.

5. The faucet spout of claim 4 wherein said release is a button mounted to said detent arm and accessible through a hole in said spout body.

6. The faucet spout of claim 5 wherein said release button is pivotably mounted to said detent arm below said first stop so as not to impede reception of said spout tube in said spout body.

7. The faucet spout of claim 1 wherein said support member further comprises a central void extending though said support member from a lower end to an upper end, said upper end received in said spout tube.

8. The faucet spout of claim 1 wherein said support member further comprises at least one annular channel about an outside surface and a resilient O-ring in said channel, said O-ring dampening said engagement between said support member and said inner surface.

9. A faucet having an adjustable height spout comprising:

a valve body housing a flow control valve and having an externally accessible means for controlling a flow of liquid through said valve, a spout body mounted to said valve body and having an aperture in a top surface for slideably receiving a spout tube, a support member mounted within said spout body in substantial alignment with said aperture so as to be slideably received within said spout tube when said spout tube is received in said spout body; said support member further comprising:

a first stop, said first stop engaging the received end of said spout tube when said spout tube is slid into said spout body to a first position at which the height of a distal end of said spout tube is at a first elevation;

a ratchet arm pivotably mounted to said support member, said ratchet arm pivotable to a stowed position wherein said ratchet arm is received within said spout tube when said spout tube is slid into said spout body to said first position, and to a deployed position wherein said ratchet arm comprises a second stop engaging said received end of said spout tube when said spout tube is slid into said spout body to a second position at which the height of said distal end of said spout tube is at a second elevation that is higher than said first elevation; and a release engaging said ratchet arm and causing said ratchet arm to pivot between said deployed position and said stowed position, a spray head mounted to said distal end of said spout tube.

10. The faucet of claim 9 wherein said spout tube further comprises an annular ring of reduced radius at said received end, and said ratchet arm further comprises a plurality of teeth regularly spaced along an external surface, at least a first tooth engaging said annular ring and comprising said second stop when said spout tube is received in said spout body to said second position and a second tooth engaging said annular ring and comprising a third stop when said spout tube is received in said spout body to a third position.

11. The faucet of claim 10 wherein said plurality of teeth are asymmetrically formed having a sloped lower surface and a substantially flat upper surface such that said annular ring may slide past said teeth in only one direction.

12. The faucet of claim 9 further comprising a spring mounted to said support member and engaging said ratchet arm to bias said ratchet into said deployed position.

13. The faucet of claim 12 wherein said release is a button, said button mounted to said ratchet arm and accessible through a hole in said spout body.

14. The faucet of claim 13 wherein said button is pivotably mounted to said ratchet arm below said first stop so as not to impede reception of said spout tube in said spout body.

15. The faucet of claim 9 wherein said support member further comprises a central void extending though said support member from said valve body to an upper end received in said spout tube, and wherein said flow control valve is in fluid connection with said spray head via said central void.

16. The faucet of claim 15 wherein further comprising a flexible tube in sealed connection with said flow control valve via and extending to said spray head via said central void.

17. The faucet spout of claim 1 wherein said support member further comprises at least one annular channel about an outside surface and a resilient O-ring in said channel, said O-ring dampening said engagement between said support member and said spout tube.

18. A faucet spout having an adjustable height comprising:

a spout tube having a circular cross section, an input end, an inside surface and an outside surface;

a spout body having a circular aperture in a top surface for slideably receiving said input end of said spout tube;

a support member mounted within said spout body and having a circular cross section for cooperative engagement with a surface of said spout tube, said support member further comprising:

a first stop, said first stop engaging said input end of said spout tube when said spout tube is slid into said spout body to a first position at which said spout tube is at a first elevation;

a ratchet arm pivotably mounted to said support member, said ratchet arm pivotable to a stowed position wherein said ratchet arm is withdrawn from the path of the spout tube when said spout tube is slid into said spout body to said first position, and to a deployed position wherein said ratchet arm comprises a second stop, blocking the path of the spout tube by engaging said input end when said spout tube is slid into said spout body to a second position at which said spout tube is at a second elevation that is higher than said first elevation;

a release engaging said ratchet arm and causing said ratchet arm to pivot between said deployed position and said stowed position.

19. The faucet spout of claim 18 wherein said input end of said spout tube further comprises an annular ring protruding radially from a surface, and said ratchet arm further comprises a plurality of teeth regularly spaced along an external surface, at least a first tooth engaging said annular ring and comprising said second stop when said spout tube is received in said spout body to said second position, and a second tooth engaging said annular ring and comprising a third stop when said spout tube is received in said spout body to a third position.

20. The faucet spout of claim 19 further comprising a spring mounted to said support member and engaging said ratchet arm to bias said ratchet into said deployed position, and wherein said release is a button, said button mounted to said ratchet arm and accessible through a hole in said spout body.

* * * * *